United States Patent [19]

Yasui et al.

[11] Patent Number: 5,051,126

[45] Date of Patent: Sep. 24, 1991

[54] CERMET FOR TOOL

[75] Inventors: Hajime Yasui, Nagoya; Junichiro Suzuki, Hashima, both of Japan

[73] Assignee: NGK Spark Plug Co., Ltd., Aichi, Japan

[21] Appl. No.: 464,040

[22] Filed: Jan. 12, 1990

[30] Foreign Application Priority Data

Jan. 13, 1989 [JP] Japan ..... 1-6791

[51] Int. Cl.[5] ..... C22C 29/04

[52] U.S. Cl. ..... 75/238; 75/242; 75/244

[58] Field of Search ..... 75/238, 242, 244

[56] References Cited

U.S. PATENT DOCUMENTS

| | | | |
|---|---|---|---|
| Re. 21,730 | 2/1941 | Schwarzkopf | 75/242 |
| 2,198,343 | 4/1940 | Kieffer | 75/242 |
| 3,752,655 | 8/1973 | Ramquist | 29/182.5 |
| 4,049,876 | 9/1977 | Yamamoto et al. | 75/242 |
| 4,145,213 | 3/1979 | Oskarsson et al. | 75/242 |
| 4,150,984 | 4/1979 | Tanaka et al. | 75/242 |
| 4,636,252 | 1/1987 | Yoshimura et al. | 75/238 |
| 4,844,738 | 7/1989 | Tanase et al. | 75/242 |
| 4,885,132 | 12/1989 | Brandt et al. | 75/242 |

FOREIGN PATENT DOCUMENTS

| | | |
|---|---|---|
| 0259192 | 9/1988 | European Pat. Off. . |
| 57-76146 | 5/1982 | Japan . |
| 63-3017 | 1/1988 | Japan . |
| 1478533 | 7/1977 | United Kingdom . |
| 1503784 | 3/1978 | United Kingdom . |
| 2015574 | 9/1979 | United Kingdom . |

*Primary Examiner*—Stephen J. Lechert, Jr.
*Assistant Examiner*—Leon Nigohosian, Jr.
*Attorney, Agent, or Firm*—Sughrue, Mion, Zinn, Macpeak & Seas

[57] ABSTRACT

A cermet contains 70 to 95 volume percentage of a hard dispersed phase and 30 to 5 volume percentage of a binder phase comprising one or more metals in group VIII (the iron group), wherein the hard dispersed phase contains as its components transitional metals in group IVb, transitional metals in group Vb, W alone of transitional metals in group VIb, C, and N, and consists of two structurally different types of particles. One type of the particles are single phase particles constituting 5% to 50% of the hard dispersed phase, whereas the other type of the particles are dual phase particles constituting 95% to 5% of the same. The cermet is for use in tools such as coating tools, spike pins, hobs, reamers, screw drivers, and so forth.

9 Claims, 1 Drawing Sheet

CERMET FOR TOOL

BACKGROUND OF THE INVENTION

1. Field of the Invention

The present invention relates to cermets used for tools such as coating tools, spike pins, scrapers, hobs, reamers, screw drivers, and so forth.

2. Prior Art

Conventionally, TiC (the chemical formula for carbon titanium; hereinafter, chemical formula or chemical symbols are used to denote chemical elements and compounds) base and Ti(C, N) base cermets have been paid attention because a) raw materials for the types of cermets are less expensive, b) the types of cermets have stronger oxidation-resistance so that tools made of such materials are less subject to oxidation during high-speed cutting in which the tools are exposed to high temperature, c) such cermets offer stronger adhesion-resistance in high temperature, and d) such cermets are chemically more stable. So the tools made of these materials are less liable to wear which occurs due to their affinity to the material to be cut when WC base alloys (cemented carbide).

This type of cermet, however, has a limited scope of application because 1) its mechanical breaking-resistance (referred to as breaking-resistance hereinafter), 2) crack extension-resistance due to thermal shock or uneven distribution of heat (referred to as thermal shock-resistance hereinafter), and 3) plastic deformation-resistance in high temperature or under high pressure (referred to as plastic deformation-resistance hereinafter) are not quite satisfactory.

Lately, sintered bodies having a hard dispersed phase (carbonitride phase) made of carbide, nitride, and carbonitride of transitional metals in groups IVb, Vb, and VIb have been proposed to overcome the problems described above. Further, various propositions have been made on the structure and composition of such sintered bodies with the aim of improving the properties of cermet (see Japan Published Examined Patent Application No. S 63-3017).

For instance, a proposed cermet containing N has WC and carbide, nitride, and carbonitride of transitional metals in group Vb. Structurally, such a cermet contains a hard dispersed phase comprising TiN single phase particles (single structural particles) and dual phase particles in which the cores are rich in transitional metals in groups IVb and the outer layers are rich in transitional metals in group Vb and VIb.

However, a sintered body having such a hard dispersed phase as described above has not successfully enhanced such performance characteristics as breaking-resistance, thermal shock-resistance, and plastic deformation-resistance without impairing the cermet's inherent properties.

More particularly, if substances such as WC and carbide, nitride, and carbonitride of transitional metals in group Vb are added to a cermet to improve breaking-resistance, thermal shock-resistance, and plastic deformation-resistance, dual phase particles grow in number, which reduces mechanical wear-resistance (referred to as wear-resistance hereinafter), and adhesion-resistance in a high temperature (referred to as temperature adhesion-resistance hereinafter).

SUMMARY OF THE INVENTION

The inventors of the present invention discovered after conducting research that, for cermet, a sintered body having a below-described composition and structure has superior breaking-resistance, thermal shock-resistance, and plastic deformation-resistance without impairing wear-resistance and temperature adhesion-resistance. The cermet of the present invention made to overcome the above-identified problems contains 70 to 95 volume percentage of a hard dispersed phase and 30 to 5 volume percentage of a binder phase comprising one or more metals in group VIII (the iron group), wherein said hard dispersed phase contains as its components transitional metals in group IVb, transitional metals in group Vb, W alone of transitional metals in group VIb, C, and N whose mole ratios herein are shown below in (1) to (3). The hard dispersed phase essentially consists of two different types of particles, Type-I particles and Type-II particles, defined below in (a) and (b), respectively.

(1) The ratio of transitional metals in group IVb, transitional metals in group Vb, and W to C and N is 1 to 0.85–1.0.

(2) The ratio of transitional metals in group IVb to transitional metals in group Vb to W is 0.5–0.85 to 0.05–0.30 to 0.05–0.30, wherein the mole ratio of Ti to all the transitional metals in group IVb is 0.8–1 to 1, and the ratio of Ta to all the transitional metals in group Vb is 0.3–1 to 1.

(3) The ratio of C to N is 0.4–0.9 to 0.1–0.6.

(a) Type-I particles account for 5–50 volume percentage of a hard dispersed phase and are single phase particles comprising one or more nitride or carbonitride of transitional metals in group IVb, wherein the ratio of N to C and N is 0.25–1 to 1.

(b) Type-II particles contains more transitional metals in group IVb in the outer layers than in the cores while said particles contain more transitional metals in group Vb and W in the cores than in the outer layers, and the content ratio of transitional metals in group IVb to transitional metals in group Vb to W changes gradually and sequentially from the cores to the outer layers.

The present invention has been made based upon the following background.

i) Background on Type-I Particles

If a sintered body containing N for use in cermet contains Type-I particles whose cores are rich in carbide, nitride, and carbonitride of transitional metals in group IVb and whose outer layers are rich in solid solutions of carbonitride of transitional metals in groups IVb, Vb and VIb, the cermet develops increasingly poorer wear-resistance and breaking-resistance as the outer layers become thicker.

It is, therefore, important to keep the formation of solid solutions thin in the outer layers and disperse particles rich in transitional metals in IVb throughout a cermet. This way the cermet is provided with high wear-resistance, adhesion-resistance, and breaking-resistance.

ii) Background on Type-II Particle

Carbide, nitride, and carbonitride of transitional metals in group Ivb Ti, Zr, HF and WC are commonly added to a sintered body containing N for use in cermet to increase thermal shock-resistance, breaking-resistance, and plastic deformation-resistance, which produces, as a component of a hard dispersed phase, dual phase particles wherein WC abound in the cores while transitional metals in group Ivb and Vb abound in the outer layers. Although the dual phase particles improve thermal shock-resistance, breaking-resistance, and plastic deformation-resistance to a certain extent, wear-resistance and adhesion-resistance which are inherent properties of a cermet decrease as an amount of Type-II particles increases in a sintered body. In other words, it is essential to restrain the development of the dual phases in Type-II particles when carbide, nitride, and carbonitride of transitional metals in group Vb and WC are added.

Based on the background described above, the inventors of the present invention have discovered that Type-II particles having the structure and the components shown in FIG. 1(*a*) significantly improve the above-described performance characteristics of a cermet.

In FIG. 1(*a*), the core and the outer layer of a Type-II particle are compared in terms of the amount of each component therein. Likewise, FIG. 1(*b*) compares the same of the conventional particle. The curved lines of FIG. 1 schematically indicates the amount of each component in the core and the outer layer and do not reflect the actual ratio therein.

As FIG. 1(*a*) shows, a Type-II particle of the present invention has a weakly developed dual phase structure without a clearly defined line distinguishing the core and the outer layer. The core is rich in transitional metals in group Vb, W, and C, while the outer layer is rich in transitional metals in group IVb and N. The content ratio of these components gradually and sequentially changes from the core to the surface: the amount of transitional metals in group Vb and W increases from the surface to the core, while transitional metals in group IVb, conversely, increases from the core to the surface. On the other hand, the prior-art particle shown in FIG. 1(*b*) has a well-developed dual phase structure, wherein the core is rich in W and C while the outer layer is rich in transitional metals in groups IVb and Vb and N. A Type-II particle of the present invention distinctively differs from the prior-art particle in that the core abounds in transitional metals in group Vb.

Due to the above described structure and composition, there is contained a larger amount of solid solutions of carbide and carbonitride of transitional metals in group Vb and WC in Type-II particles of the present invention than in the conventional particles, which allows performance characteristics of carbide and carbonitride of transitional metals in group Vb and WC such as thermal shock-resistance to be fully developed, while breaking-resistance, a performance characteristic of WC, is also improved. Furthermore, the reduction of temperature adhesion-resistance, which is caused by addition of WC, is minimized. Since a large amount of solid solutions of carbide, nitride, and carbonitride of transitional metals in group Vb are contained in the core, thermal shock-resistance is enhanced. Further, the reduction of wear-resistance caused by addition of transitional metals in group Vb is minimized because the content ratio of solid solutions of transitional metals in group Vb is low in the outer layer.

The inventors of the present invention performed experiments on the content ratio of Type-I and Type-II essentially constituting a hard dispersed phase. The content ratio of Type-I particles to Type-II particles was gradually changed until the ratio which maximizes the performance characteristics was discovered.

W alone, excluding Mo, of the transitional metals in group VIb is used for this invention because solid solutions made of Mo and transitional metals in groups IVb and Vb are easily formed in Type-I particles if Mo is added, which renders the structure in the outer layers of Type-I particles fragile. Therefore, breaking-resistance is impaired. Moreover, addition of Mo would reduce thermal shock-resistance and breaking-resistance because the formation of solid solutions of W and a binder phase is limited due to the fact that Mo more easily forms a solid solution with a binder phase than W does.

The following are the reasons that the structure and components for the present invention have been determined as described above (see Pages 3 and 4 of the present specification).

1) The volume percentage of a hard dispersed phase and the same of a binder phase (70 to 95% and 5 to 30%, respectively) in the cermet for the present invention has been determined for the following reasons.

If a cermet contains less than 70% by volume of a hard dispersed phase or more than 30% by volume of a binder phase, wear-resistance, temperature adhesion-resistance, and plastic deformation-resistance are adversely affected. On the other hand, if the volume percentage of a hard dispersed phase is set over 95% or the volume percentage of a binder phase is set below 5%, breaking-resistance and thermal shock-resistance are adversely affected.

So, these performance characteristics are fully developed if the volume percentages of a hard dispersed phases and that of a binder phase is set in the range from 70 to 95% and from 5 to 30%, respectively.

2) The mole ratio of transitional metals in group IVb to transitional metals in group Vb to W (0.5–0.85 to 0.05–0.30 to 0.05 to 0.30) has been determined for the following reasons.

If the amount of transitional metals in group IVb in the above ratio is below 0.5, the content ratio of single phase particles (Type-I particles) is kept too low, which results in reduction of wear-resistance and temperature adhesion-resistance. Further, such a low amount of transitional metals in group IVb reduces the formation of a solid solution of transitional metals in group IVb in the outer layers of Type-II particles, hence making the content ratio of transitional metals in group Vb and W in the outer layer too high. Consequently, wear-resistance and temperature adhesion-resistance are impaired.

If the amount of transitional metals in group IVb in the above ratio exceeds 0.85, thermal shock-resistance and breaking-resistance are impaired because the content ratio of Type-II particles becomes too low. Excessive solid solution easily forms in the outer layers of Type-I particles to affect wear-resistance and breaking-resistance. Furthermore, because the content ratio of solid solutions of transitional metals in group IVb becomes too high in the cores of Type-II particles, properties of transitional metals in group Vb and W such as thermal shock-resistance and breaking-resistance are reduced.

Therefore, if the amount of transitional metals in group IVb in the above ratio is set between 0.5 and 0.85, the above-identified characteristics are maximized.

(3) The mole ratio of transitional metals in group Vb to transitional metals in group IVb to W (0.05–0.30) to 0.5–0.85 to 0.05–0.30) has been determined for the following reasons.

If the amount of transitional metals in group Vb is below 0.05, the content ratio of the components (especially W and transitional metals in group IVb) does not change gradually and sequentially and particles similar to the conventional dual phase particles having cores rich in W and outer layers rich in transitional metals in group IVb are easily formed to reduce thermal shock-resistance and plastic deform-resistance.

If the amount is over 0.3, the outer layers of Type-II particles contain too much transitional metal from group Vb, resulting in reduction of wear-resistance due to excess of transitional metals in group Vb. Further, excessive solid solutions are apt to form in the outer layers of Type-I particles to reduce wear-resistance and breaking-resistance.

On the other hand, if the amount of transitional metals in group Vb set in the range from 0.05 to 0.3, the above-identified performance characteristics are maximized.

(4) The mole ratio of W to transitional metals in group IVb to transitional metals in group Vb (0.05–0.30 to 0.5–0.85 to 0.05–0.30) has been determined for the following reasons.

If the amount of W is below 0.05 in the above ratio, growth of Type-II particles is checked and wettability of Type-II particles by a binder phase is decreased. Therefore, Type-II particles become fragile and impair thermal shock-resistance and breaking-resistance.

If the amount of W is over 0.3, Type-BI solid solution of W and transitional metals in groups IVb and Vb (especially those in group Vb does not form and solid solution rich in WC deposits. Then, the content ratio of the components does not change gradually and sequentially from the cores to the outer layers to reduce wear-resistance and temperature adhesion-resistance. Moreover, since W does not easily combine with N, decomposition of N is apt to occur, producing pores and blowholes. Consequently, wear-resistance and breaking-resistance decrease.

Therefore, if the amount of W in the above ratio is set between 0.05 and 0.3, superior performance characteristics can be obtained.

(5) The mole ratio of C to N (0.4–0.9 to 0.1 0.6) has been determined for the following reasons.

If the amount of C is more than 0.9 and the amount of N is less than 0.1 in the above ratio, growth of Type-I and Type-II particles becomes excessive so that the diameter of the particles become too large. Excessive solid solutions easily form in the outer layers of Type-I particles so that less Type-I particles (single phase particles) form. Further, because solid solutions of transitional metals in group IVb is formed at too high a rate, performance characteristics obtained by addition of W and transitional metals in groups Vb are reduced, the reduced characteristics being wear-resistance, breaking-resistance, thermal shock-resistance, and plastic deformation-resistance.

If the amount of C in the above-described ratio is less than 0.4 and the amount of N in the above-described ratio is more than 0.6, decomposition of N easily occurs to produce pores and blowholes. The content ratio of Type-II particles becomes too low. Further, Type-BI solid solution of W and transitional metals in groups IVb and Vb (especially those in group Vb does not form and solid solution rich in WC deposits. Consequently, the content ratio of the components does not change gradually and sequentially from the cores to the outer layers. If too much N is contained in the cermet, the range of sintering temperature becomes too high. As a result, excessive solid solutions are easily formed in the outer layers of Type-II particles. For these reasons, wear-resistance, breaking-resistance, and temperature adhesion-resistance decrease.

If the mole ratio of C to N is in the range of 0.4–0.9 to 0.1–0.6, the above-mentioned performance characteristics becomes superior.

(6) The mole ratio of transitional metals in group IVb, transitional metals in group Vb, and W to C and N (1 to 0.85–1.0) has been determined for the following reasons(IVb+Vb+W/C+N ratio).

If the amount of C and N in the above-described ratio is less than 0.85, a harmful chemical substance materializes to impair breaking-resistance.

If the amount of C and N in the above-described ratio is more than 1.0, a graphite phase easily deposits and the stoichiometric composition of a sintered body becomes imperfect to reduce breaking-resistance.

If the ratio is 1 to 0.85–1.0, a superior characteristic mentioned above is obtained. A proper mole ratio is determined by the ratio of N to C and N; the greater the N/C+N ratio is, the smaller the IVb+Vb+W/C+N ratio is.

(7) The mole ratio of Ti to all the transitional metals in group IVb (0.8–1 to 1) has been determined for the following reasons.

As the amount of Zr and Hf in group IVb increases, wear-resistance, thermal shock-resistance, and plastic deformation-resistance can be expected to improve. However, if the amount of Zr and Hf is more than 0.2, the degree of sintering lowers, hence reducing wear-resistance and breaking-resistance.

If the mole ratio of Ti to all the transitional metals in group IVb is 0.8–1 to 1 , superior performance characteristics are obtained.

(8) The mole ratio of Ta to transitional metals in group Vb (0.3–1 to 1) has been determined for the following reasons.

Ti and Nb, which are transitional metals in group Vb, are added to improve thermal shock-resistance and plastic deformation-resistance. It is common to use Nb in part in the place of expensive Ta. However, if the amount of Ta in the above-shown ratio is less than 0.3, restraint on particle growth in a hard dispersed phase becomes extremely weak and wear-resistance, breaking-resistance, and thermal shock-resistance deteriorate.

If the mole ratio of Ta to all the transitional metals in group Vb is 0.3–1 to 1, the above-mentioned performance characteristics become superior.

(9) The mole ratio of N to C and N in Type-I particles (0.25–1 to 1) has been determined for the following reasons.

Type-I particles, if they are made small in size, large in number, and evenly distributed throughout a sintered body, improve wear-resistance, breaking-resistance, and plastic deformation-resistance. If the mole ratio of N to C and N is less than 0.25, excessive solid solutions easily forms in the outer layers of Type-I particles and particle growth becomes excessive, which deteriorates the above-described performance characteristics.

If the ratio of N to C and N is 0.25–1 to 1, these performance characteristics become superior.

(10) Type-I particles account for 5–50 volume percentage of a hard dispersed phase. This percentage has been determined by the following reasons.

Generally, the outer layer of a dual phase particle comprises solid solutions of transitional metals in groups IVb, Vb, and VIb. It is known that the thicker the layer is, the poorer wear-resistance and breaking-resistance are. Therefore, it is important to secure a predetermined percentage (5–50 volume percentage in this invention) of the single phase particles in a hard dispersed phase by making the outer layers thin. Thus, superior wear-resistance and breaking-resistance of Type-I particles are guaranteed. It is also important to disperse transitional metals in group IVa evenly throughout Type-I particles (single phase particles) to obtain high wear-resistance and temperature adhesion-resistance. Type-I particles (single phase particles) are small in size so that they easily disperse to improve plastic deformation-resistance.

Therefore, if a hard dispersed phase contains less than 5% by volume of Type-I particles, high wear-resistance and plastic deformation-resistance cannot be obtained. Further, an excessive amount of transitional metals in group IVb is contained in the form of solid solution in Type-II particles if there is only less than 5 volume percentage of Type-I particles in a hard dispersed phase. Consequently, performance characteristics of Type-II particles such as breaking-resistance and temperature adhesion-resistance deteriorate.

On the other hand, if a hard dispersed phase contains more than 50 volume percentage of Type-I particles, there is contained too small an amount of Type-II particles, which causes deterioration of wear-resistance and thermal shock-resistance. Moreover, since much of transitional metals in groups IVb is used to form Type-I particles, there is contained not enough amount of solid solution of transitional metals in group IVb in the outer layer of Type-II particles. Thus, wear-resistance decreases.

If a hard dispersed phase contains in the range from 5 to 50 volume percentage of Type-I particles, the above-identified performance characteristics improve.

DETAILED DESCRIPTION OF THE PREFERRED EMBODIMENTS

Figure 1A:
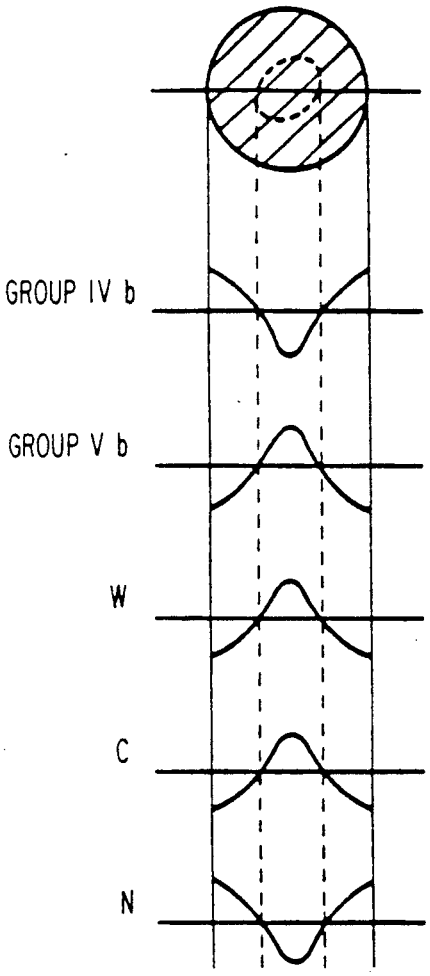
FIGS. 1(*a*) and 1(*b*) are schematic sectional views of a Type-II particle of the present invention and a prior-art dual phase particle, respectively. The line charts below the drawing of each particle schematically indicate the amount of each component contained in the core and the outer layer and do not reflect the actual amount thereof.
Figure 1B:
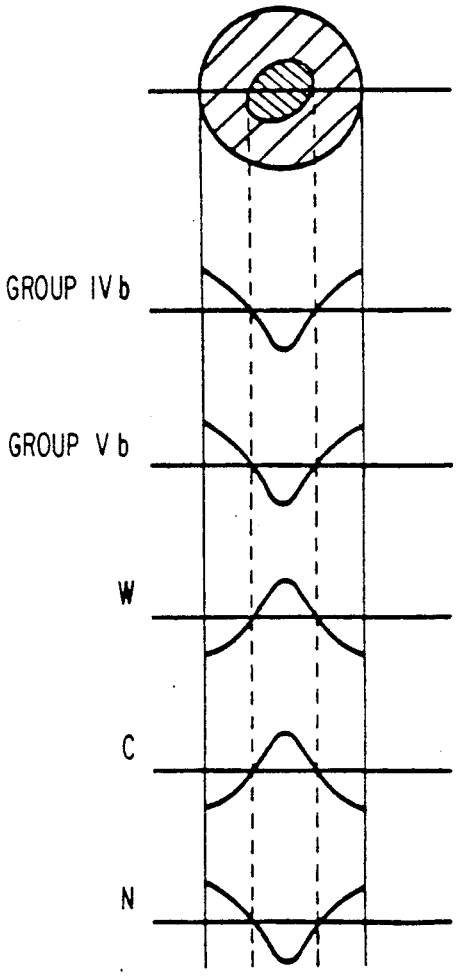

The embodiments of the present invention will be explained hereinafter.

A cermet for tools for the present invention is manufactured in the following method.

First, solid solutions used as materials for cermet are manufactured.

Powdered materials shown in Table 1 which are commercially available powder metallurgical materials, are mixed in a ratio shown in Table 2 in a stainless-steel ball mill. Solid solutions not containing nitrogen, (Ta, W, Mo) C and (Ta, Nb, W) C, are manufactured by means of heating in vacuum at a temperature ranging from 1500 to 1800 degree centigrade for one to five hours while solid solutions containing carbonitride, (Ti, Ta, W) (C, N), are manufactured in the same conditions except that heating is performed in an air stream under nitrogen partial pressure of 50 to 650 torr. Then, the manufactured solid solutions were milled to obtain solid solution particles having mean particle diameter ranging from 1.0 to 1.7 micrometer.

The mole ratio of the components contained in the obtained solid solution powder was measured by chemical analysis. The results are shown in Table 2. X-ray diffraction was performed to confirm that the mole ratio of the components such as carbide, nitride, and carbonitride of Ta, Nb, W, and Mo contained in the solid solution powder does not change throughout the powder; that is to say, the solid solutions have uniform composition therein.

Second, a predetermined proportion of the above-mentioned materials shown in Table 1 and the above-described solid solution shown in Table 2 are mixed by the combinations specified in Table 3. Secondly, acetone is added to this mixture to be milled and mixed for 50 to 120 hours. Further, drying was performed and paraffin totaling 1.0% by weight of the mixture is mixed into the mixture. Then, pressure of 1.5 kg per square millimeter is applied to the mixture. After the pressed mixture was degreased, it is heated for about three hours until the mixture reaches a temperature ranging from 1,000 to 1,200 degrees centigrade in a vacuum furnace. The mixture is now held in an Ar gas atmosphere under a pressure ranging from −60 to −25 centimeter Hg at a temperature ranging from 1,400 to 1,550 degrees centigrade for one hour. Furthermore, the mixture is cooled down to 1,000 degrees centigrade at a rate of 5 to 30 degrees centigrade per minute to obtain Sample Sintered Bodies from No. 1 to No. 64 shown in Table 4.

Chemical analysis was performed on the sample sintered bodies (referred to as samples hereinafter) comprising a hard dispersed phase to determine the components of said hard dispersed phase, the components being transitional metals in groups IVb, Vb, and VIb, C, and N. The mole and volume percentages of transitional metals contained in the hard dispersed phase were determined by using a transmission electron microscope. The results of the chemical analysis and the microscopic measurement are shown in Table 4. The ratio of N to C and N in Type-I particles of each sample was also determined by Auger analysis; the ratios of Samples No. 1 to 24 which are the embodiments of the present invention were 0.25 or more. Harmful substances such as graphite or a decarbonized phase were observed in none of the samples from No. 1 to 64.

The capitalized alphabets of the left column of Table 3 denote the combinations of the compositions of the samples, of which E, F, G, I, and J are the combinations of the samples for the present invention and A, B, C, D, H, K, and L are the combination of the samples provided for the purpose of comparison and are not combinations according to the present invention. Likewise, Samples No. 1 to 24 of the Table 4 are the sintered bodies for the present invention while Samples No. 25 to 64 are sintered bodies provided for the purpose of comparison. Table 4 shows the mole percentage of each element of each hard dispersed phase, the volume percentage of the hard dispersed phase and the binder phase in each sample, and the sintering temperature at which sintering was conducted for each sample.

The structure and composition of the particles contained in Samples No. 1 to 64 were studied to identify the following five types of particles: Type-I, II, III, IV, and V particles. The samples for the present invention (Samples No. 1 to 24) uniquely consist of Type-I and Type-II particles, whose structure and composition have already been described in detail above. Therefore, no further description of the two types of particles is provided.

Type-III particles are dual phase particles having cores rich in transitional metals in group IVb and devoid of transitional metals in groups Vb and VIb and outer layers rich in transitional metals in groups Vb and VIb.

Type-IV particles are dual phase particles whose cores are rich in transitional metals in group VIb and devoid of transitional metals in groups IVb and Vb and whose outer layers are rich in transitional metals in groups IVb and Vb.

Type-V particles, formed only in the hard dispersed phase manufactured by the combination denoted by K of Table 3, are single phase particles without cores and have solid solutions of transitional metals in groups IVb, Vb, and VIb uniformly distributed throughout therein so that the mole ratio of the components thereof does not change distinctively from the core to the surface.

Table 5 indicates the types of particles included in the hard dispersed phase of each Sample.

The operational lives of Samples No. 1 to 64 were estimated by the following four cutting tests.

Test 1 (turning)

Tip shape: Japan Industrial Standard SNP432
Work material: Japan Industrial Standard SNCM8 (Brinell hardness: BH300)
Cutting speed: 200 meter per minute
Feed rate: 0.2 millimeter per revolution
Depth of cut: 1.5 millimeter
Estimation of life: Time (minutes) required for flank wear (VB) to reach 0.2 millimeter (under a dry condition where coolant was not used)

Test 2 (milling)

Tip shape: Japan Industrial Standard SPP422
Work material: Japan Industrial Standard SCM440H (Brinell hardness: BH240)
Cutting speed: 244 meter per minute
Feed rate: 0.12 millimeter per revolution
Depth of cut: 3 millimeter
Estimation of life: Time (minutes) required for flank wear (VB) to reach 0.2 millimeter (under a dry condition where coolant was not used)

Test 3 (milling)

Tip shape: Japan Industrial Standard SPP422
Work material: Japan Industrial Standard SCM440H (Brinell hardness: BH240)
Cutting speed: 150 meter per minute
Feed rate: 0.25 millimeter per revolution
Depth of cut: 1.5 millimeter
Estimation of life: Number of impact frequencies until broken (under a dry condition)

Test 4 (turning)

Tip shape: Japan Industrial Standard SNP432
Work material: Japan Industrial Standard SNCM8 (Brinell hardness: BH300)
Cutting speed: 200 meter per minute
Feed rate: 0.38 millimeter per revolution
Depth of cut: 1.5 millimeter
Estimation of life: Number of impact frequencies until broken (under a condition that water soluble coolant was applied to the tip)

Table 6 shows the results of the four tests.

TABLE 1

| NO. | RAW MATERIALS (COMPOUNDS, SOLID SOLUTIONS) | MEAN PARTICLE DIAMETER (μm) | MOLE RATIO OF THE COMPOUNDS OF THE SOLID SOLUTIONS (x, y, z) | | | | | |
|---|---|---|---|---|---|---|---|---|
| 1 | TiC | 1.0 | | | | | | |
| 2 | TiN | 1.0 | | | | | | |
| 3 | TaC | 1.5 | | | | | | |
| 4 | WC | 1.0 | | | | | | |
| 5 | $Mo_2C$ | 1.5 | | | | | | |
| 6 | (Ta, Nb)C | 1.0 | (Tax, Nby)C | x + y = 1 | x = 0.33, 0.67, 0.20 | | | |
| 7 | (Ta, W)C | 1.0 | (Tax, Wy)C | x + y = 1 | x = 0.2, 0.33, 0.5, 0.67, 0.8 | | | |
| 8 | Ti(C, N) | 1.0 | Ti(Cx, Ny) | x + y = 1 | x = 0.1, 0.3, 0.5, 0.7 | | | |
| 9 | (Ti, Zr)(C, N) | 1.7 | (Tix, Zry)(C0.5, N0.5) | x + y = 1 | x = 0.75, 0.8, 0.85 | | | |
| 10 | (W, Mo)C | 1.2 | (Wx, Moy)C | x + y = 1 | x = 0.7 | | | |
| 11 | (Ti, Ta, W)C | 1.0 | (Tix, Tay, Wz)C | x + y + z = 1 | x = 0.70, y = 0.15, z = 0.15 | 0.62, 0.19, 0.19 | 0.44, 0.28, 0.28 | 0.28, 0.36, 0.36 |

TABLE 2

| WEIGHT RATIO OF THE MIXED COMPOUNDS | MOLE RATIO OF THE COMPONENTS OF THE SOLID SOLUTIONS |
|---|---|
| (1) (Ta, Nb, W)C TaC:NbC:WC | |
| 1:1:2 | (Ta0.21 Nb0.37 W0.42)C |
| 3:1:4 | (Ta0.35 Nb0.20 W0.45)C |
| 1:3:4 | (Ta0.10 Nb0.51 W0.39)C |
| (2) (Ti, Ta, W)(C, N) TiC:TiN:TaC:WC | |
| 2.8:3.2:2:2 | (Ti0.82 Ta0.09 W0.09)(C0.61 N0.39) |
| 1.8:2.2:2:2 | (Ti0.76 Ta0.12 W0.12)(C0.64 N0.36) |
| 2.8:3.2:2:4 | (Ti0.76 Ta0.08 W0.16)(C0.65 N0.35) |
| 2.8:3.2:4:2 | (Ti0.75 Ta0.17 W0.08)(C0.65 N0.35) |
| (3) (Ta, W, Mo)C TaC:WC:$Mo_2C$ | |
| 1:1:1 | (Ta0.26 W0.25 Mo0.49)C |
| 2:3:1 | (Ta0.29 W0.43 Mo0.28)C |
| 3:2:1 | (Ta0.44 W0.29 Mo0.27)C |

TABLE 3

| REFERENCE SYMBOL FOR EACH COMBINATION | COMBINATION: HARD DISPERSED PHASE | COMBINATION: BINDER PHASE |
|---|---|---|
| A | TiC + TiN + TaC + WC | |
| B | TiC + TiN + TaC + WC + $MO_2C$ | |
| C | TiC + TiN + (Ta, Nb)C + WC | |
| D | TiC + TiN + TaC + (W, Mo)C | |
| E* | Ti(C,N) + (Ta, Nb, W)C | |
| F* | Ti(C, N) + (Ta, W)C | Ni + Co |
| G* | Ti(C, N) + (Ti, Ta, W)C | |
| H | TiN + (Ta, W)C | |
| I* | TiN + (Ti, Ta, W)C | |

TABLE 3-continued

| REFERENCE SYMBOL FOR EACH COMBINATION | COMBINATION: HARD DISPERSED PHASE | COMBINATION: BINDER PHASE |
|---|---|---|
| J* | (Ti, Zr)(C, N) + (Ta, W)C | |
| K | (Ti, Ta, W)(C, N) | |
| L | Ti(C, N) + (Ta, W, Mo)C | |

*EMBODIMENTS FOR THE PRESENT INVENTION

TABLE 4

| SAMPLE NO. | COMBINATION | COMPONENTS OF HARD DISPERSED PHASE: MOLE PERCENT OF EACH ELEMENT IN METALS IN GROUPS IVb Vb & VIb: Gr.IVb Ti | Gr.IVb Zr | Gr.Vb Ta | Gr.Vb Nb | Gr.VIb W | Gr.VIb Mo | MOLE PERCENT OF EACH GROUP IN ALL GROUPS: Gr. IVb | Gr. Vb | Gr. VIb | MOLE RATIO OF C TO N: C | N | VOLUME PERCENT WHEN MIXED | BINDER PHASE VOLUME PERCENT WHEN MIXED: Ni | Co | SINTERING TEMPERATURE (°C.) |
|---|---|---|---|---|---|---|---|---|---|---|---|---|---|---|---|---|
| 1 | E | 72 | — | 6 | 11 | 11 | — | 72 | 17 | 11 | 67 | 33 | 88 | 4 | 8 | 1450 |
| 2 | E | 74 | — | 9 | 5 | 12 | — | 74 | 14 | 12 | 65 | 35 | 88 | 4 | 8 | 1450 |
| 3 | F | 52 | — | 24 | — | 24 | — | 52 | 24 | 24 | 77 | 23 | 88 | 4 | 8 | 1450 |
| 4 | F | 62 | — | 19 | — | 19 | — | 62 | 19 | 19 | 72 | 28 | 88 | 4 | 8 | 1450 |
| 5 | F | 62 | — | 19 | — | 19 | — | 62 | 19 | 19 | 87 | 13 | 88 | 4 | 8 | 1440 |
| 6 | F | 62 | — | 19 | — | 19 | — | 62 | 19 | 19 | 68 | 32 | 88 | 4 | 8 | 1450 |
| 7 | F | 76 | — | 12 | — | 12 | — | 76 | 12 | 12 | 65 | 35 | 88 | 4 | 8 | 1450 |
| 8 | F | 76 | — | 8 | — | 16 | — | 76 | 8 | 16 | 64 | 36 | 88 | 4 | 8 | 1450 |
| 9 | F | 76 | — | 8 | — | 16 | — | 76 | 8 | 16 | 80 | 20 | 88 | 4 | 8 | 1400 |
| 10 | F | 76 | — | 17 | — | 7 | — | 76 | 17 | 7 | 64 | 36 | 88 | 4 | 8 | 1400 |
| 11 | F | 83 | — | 9 | — | 8 | — | 83 | 9 | 8 | 61 | 39 | 88 | 4 | 8 | 1500 |
| 12 | F | 68 | — | 16 | — | 16 | — | 68 | 16 | 16 | 69 | 31 | 88 | 4 | 8 | 1450 |
| 13 | F | 68 | — | 16 | — | 16 | — | 68 | 16 | 16 | 55 | 45 | 88 | 4 | 8 | 1550 |
| 14 | F | 68 | — | 7 | — | 25 | — | 68 | 7 | 25 | 70 | 30 | 88 | 4 | 8 | 1450 |
| 15 | F | 68 | — | 26 | — | 6 | — | 68 | 26 | 6 | 69 | 31 | 88 | 4 | 8 | 1450 |
| 16 | G | 76 | — | 12 | — | 12 | — | 76 | 12 | 12 | 61 | 39 | 88 | 4 | 8 | 1500 |
| 17 | G | 76 | — | 12 | — | 12 | — | 76 | 12 | 12 | 85 | 15 | 88 | 4 | 8 | 1400 |
| 18 | I | 76 | — | 12 | — | 12 | — | 76 | 12 | 12 | 44 | 56 | 88 | 4 | 8 | 1550 |
| 19 | I | 76 | — | 12 | — | 12 | — | 76 | 12 | 12 | 64 | 36 | 88 | 4 | 8 | 1500 |
| 20 | I | 83 | — | 8 | — | 9 | — | 83 | 8 | 9 | 61 | 39 | 88 | 4 | 8 | 1450 |
| 21 | J | 58 | 10 | 16 | — | 16 | — | 68 | 16 | 16 | 69 | 31 | 88 | 4 | 8 | 1500 |
| 22 | J | 64 | 16 | 10 | — | 10 | — | 80 | 10 | 10 | 63 | 37 | 88 | 4 | 8 | 1500 |
| 23 | F | 76 | — | 12 | — | 12 | — | 76 | 12 | 12 | 66 | 34 | 79 | 7 | 14 | 1450 |
| 24 | F | 76 | — | 12 | — | 12 | — | 76 | 12 | 12 | 65 | 35 | 94 | 2 | 4 | 1500 |
| 25 | F | 76 | — | 12 | — | 12 | — | 76 | 12 | 12 | 67 | 33 | 97 | 1 | 2 | 1550 |
| 26 | F | 76 | — | 12 | — | 12 | — | 76 | 12 | 12 | 66 | 34 | 67 | 11 | 22 | 1400 |
| 27 | A | 76 | — | 12 | — | 12 | — | 76 | 12 | 12 | 68 | 32 | 88 | 4 | 8 | 1450 |
| 28 | A | 76 | — | 8 | — | 16 | — | 76 | 8 | 16 | 67 | 33 | 88 | 4 | 8 | 1450 |
| 29 | A | 68 | — | 7 | — | 25 | — | 68 | 7 | 25 | 72 | 28 | 88 | 4 | 8 | 1450 |
| 30 | A | 52 | — | 24 | — | 24 | — | 52 | 24 | 24 | 82 | 18 | 88 | 4 | 8 | 1450 |
| 31 | A | 82 | — | 9 | — | 9 | — | 82 | 9 | 9 | 64 | 36 | 88 | 4 | 8 | 1500 |
| 32 | B | 73 | — | 11 | — | 11 | 5 | 73 | 11 | 16 | 67 | 33 | 88 | 4 | 8 | 1450 |
| 33 | B | 69 | — | 12 | — | 6 | 3 | 69 | 12 | 9 | 64 | 36 | 88 | 4 | 8 | 1400 |
| 34 | C | 72 | — | 6 | 11 | 11 | — | 72 | 17 | 11 | 69 | 31 | 88 | 4 | 8 | 1450 |
| 35 | C | 74 | — | 9 | 5 | 12 | — | 74 | 14 | 12 | 67 | 33 | 88 | 4 | 8 | 1450 |
| 36 | C | 71 | — | 3 | 15 | 11 | — | 71 | 18 | 11 | 69 | 31 | 88 | 4 | 8 | 1450 |
| 37 | D | 73 | — | 11 | — | 11 | 5 | 73 | 11 | 16 | 66 | 34 | 88 | 4 | 8 | 1450 |
| 38 | D | 69 | — | 12 | — | 6 | 3 | 69 | 12 | 9 | 65 | 35 | 88 | 4 | 8 | 1400 |
| 39 | E | 72 | — | 6 | 11 | 11 | — | 72 | 17 | 11 | 69 | 31 | 88 | 4 | 8 | 1550 |
| 40 | E | 71 | — | 3 | 15 | 11 | — | 71 | 18 | 11 | 68 | 32 | 88 | 4 | 8 | 1450 |
| 41 | F | 76 | — | 12 | — | 12 | — | 76 | 12 | 12 | 67 | 33 | 88 | 4 | 8 | 1550 |
| 42 | F | 83 | — | 9 | — | 8 | — | 83 | 9 | 8 | 63 | 37 | 88 | 4 | 8 | 1550 |
| 43 | F | 83 | — | 9 | — | 8 | — | 83 | 9 | 8 | 44 | 56 | 88 | 4 | 8 | 1550 |
| 44 | F | 52 | — | 24 | — | 24 | — | 52 | 24 | 24 | 81 | 19 | 88 | 4 | 8 | 1550 |
| 45 | F | 86 | — | 7 | — | 7 | — | 86 | 7 | 7 | 61 | 39 | 88 | 4 | 8 | 1500 |
| 46 | F | 86 | — | 7 | — | 7 | — | 86 | 7 | 7 | 63 | 37 | 88 | 4 | 8 | 1550 |
| 47 | F | 44 | — | 28 | — | 28 | — | 54 | 28 | 28 | 81 | 19 | 88 | 4 | 8 | 1500 |
| 48 | G | 76 | — | 12 | — | 12 | — | 76 | 12 | 12 | 92 | 8 | 88 | 4 | 8 | 1400 |
| 49 | H | 62 | — | 19 | — | 19 | — | 62 | 19 | 19 | 41 | 59 | 88 | 4 | 8 | 1550 |
| 50 | H | 62 | — | 30 | — | 8 | — | 62 | 30 | 80 | 42 | 58 | 88 | 4 | 8 | 1550 |
| 51 | I | 76 | — | 12 | — | 12 | — | 76 | 12 | 12 | 37 | 63 | 88 | 4 | 8 | 1550 |
| 52 | I | 83 | — | 8 | — | 9 | — | 83 | 8 | 9 | 35 | 65 | 88 | 4 | 8 | 1550 |
| 53 | J | 54 | 18 | 14 | — | 14 | — | 72 | 14 | 14 | 67 | 33 | 88 | 4 | 8 | 1550 |
| 54 | K | 76 | — | 12 | — | 12 | — | 76 | 12 | 12 | 64 | 36 | 88 | 4 | 8 | 1450 |
| 55 | K | 76 | — | 8 | — | 16 | — | 76 | 8 | 16 | 64 | 36 | 88 | 4 | 8 | 1450 |
| 56 | K | 75 | — | 17 | — | 8 | — | 76 | 17 | 8 | 65 | 35 | 88 | 4 | 8 | 1450 |
| 57 | K | 52 | — | 24 | — | 24 | — | 52 | 24 | 24 | 77 | 23 | 88 | 4 | 8 | 1450 |
| 58 | K | 82 | — | 9 | — | 9 | — | 82 | 9 | 9 | 63 | 37 | 88 | 4 | 8 | 1500 |
| 59 | K | 82 | — | 9 | — | 9 | — | 82 | 9 | 9 | 44 | 56 | 88 | 4 | 8 | 1550 |
| 60 | K | 52 | — | 24 | — | 24 | — | 52 | 24 | 24 | 86 | 14 | 88 | 4 | 8 | 1400 |
| 61 | L | 62 | — | 10 | — | 10 | 18 | 62 | 10 | 28 | 72 | 28 | 88 | 4 | 8 | 1450 |
| 62 | L | 65 | — | 10 | — | 15 | 10 | 65 | 10 | 25 | 71 | 29 | 88 | 4 | 8 | 1450 |
| 63 | L | 52 | — | 12 | — | 12 | 24 | 52 | 12 | 36 | 77 | 23 | 88 | 4 | 8 | 1450 |
| 64 | L | 65 | — | 15 | — | 10 | 10 | 65 | 15 | 20 | 72 | 28 | 88 | 4 | 8 | 1450 |

TABLE 5

| SAMPLE NO. | MOLE PERCENT OF N IN C AND N | TYPES OF PARTICLES CONTAINED IN EACH SAMPLES | | | | VOLUME PERCENT OF TYPE-I PARTICLES OF ALL TYPES OF PARTICLES IN HARD DISPERSED PHASE |
|---|---|---|---|---|---|---|
| | | TYPE-I | TYPE-II | TYPE-III | TYPE-IV | |
| 1 | 33 | X | X | | | 24 |
| 2 | 35 | X | X | | | 23 |
| 3 | 23 | X | X | | | 13 |
| 4 | 28 | X | X | | | 19 |
| 5 | 13 | X | X | | | 7 |
| 6 | 32 | X | X | | | 20 |
| 7 | 35 | X | X | | | 25 |
| 8 | 36 | X | X | | | 26 |
| 9 | 20 | X | X | | | 14 |
| 10 | 36 | X | X | | | 25 |
| 11 | 39 | X | X | | | 28 |
| 12 | 31 | X | X | | | 17 |
| 13 | 45 | X | X | | | 35 |
| 14 | 30 | X | X | | | 19 |
| 15 | 31 | X | X | | | 16 |
| 16 | 39 | X | X | | | 31 |
| 17 | 15 | X | X | | | 7 |
| 18 | 56 | X | X | | | 46 |
| 19 | 36 | X | X | | | 27 |
| 20 | 39 | X | X | | | 34 |
| 21 | 31 | X | X | | | 28 |
| 22 | 37 | X | X | | | 39 |
| 23 | 34 | X | X | | | 27 |
| 24 | 35 | X | X | | | 26 |
| 25 | 33 | X | X | X | | 0 |
| 26 | 34 | X | X | | | 0 |
| 27 | 32 | | | X | X | 0 |
| 28 | 33 | | | X | X | 0 |
| 29 | 28 | | | X | X | 0 |
| 30 | 18 | | | X | X | 0 |
| 31 | 36 | | | X | | 0 |
| 32 | 33 | | | X | | 0 |
| 33 | 36 | | | X | X | 0 |
| 34 | 31 | | | X | X | 0 |
| 35 | 33 | X | | X | X | 0 |
| 36 | 31 | | | X | X | 0 |
| 37 | 34 | | | X | X | 0 |
| 38 | 35 | | | X | X | 0 |
| 39 | 31 | | | X | | 0 |
| 40 | 32 | X | X | X | | 0 |
| 41 | 33 | | | X | | 0 |
| 42 | 37 | | | X | | 0 |
| 43 | 56 | X | X | X | | 0 |
| 44 | 19 | | X | X | X | 0 |
| 45 | 39 | X | X | X | | 0 |
| 46 | 37 | | | X | | 0 |
| 47 | 19 | X | X | | | 0 |
| 48 | 8 | | | X | | 0 |
| 49 | 59 | X | X | X | | 0 |
| 50 | 58 | | | X | | 0 |
| 51 | 63 | X | | X | | 0 |
| 52 | 65 | X | | X | | 0 |
| 53 | 33 | X | X | X | | 0 |
| 54 | 36 | | | X | | 0 |
| 55 | 36 | | | X | X | 0 |
| 56 | 35 | | | X | | 0 |
| 57 | 23 | | | X | X | 0 |
| 58 | 37 | | | X | | 0 |
| 59 | 56 | | | X | | 0 |
| 60 | 14 | | | X | X | 0 |
| 61 | 28 | | X | X | | 0 |
| 62 | 29 | X | X | X | | 0 |
| 63 | 23 | | X | X | | 0 |
| 64 | 28 | | X | X | | 0 |

TABLE 6

| SAMPLE NO. | TEST 1 TIME REQUIRED FOR FLANK WEAR TO REACH 0.2 mm (MINUTES) | TEST 2 ← | TEST 3 NUMBER OF IMPACT FREQUENCIES UNTIL BROKEN | TEST 4 ← |
|---|---|---|---|---|
| 1 | 16 | 23 | 963 | 716 |
| 2 | 18 | 25 | 1046 | 875 |
| 3 | 13 | 15 | 1195 | 1087 |
| 4 | 18 | 25 | 1052 | 947 |

TABLE 6-continued

| SAMPLE NO. | TEST 1 TIME REQUIRED FOR FLANK WEAR TO REACH 0.2 mm (MINUTES) | TEST 2 ← | TEST 3 NUMBER OF IMPACT FREQUENCIES UNTIL BROKEN | TEST 4 ← |
|---|---|---|---|---|
| 5 | 16 | 21 | 825 | 704 |
| 6 | 18 | 25 | 1174 | 1049 |
| 7 | 19 | 27 | 1064 | 979 |
| 8 | 21 | 28 | 1005 | 846 |
| 9 | 17 | 19 | 875 | 729 |
| 10 | 22 | 28 | 793 | 654 |
| 11 | 19 | 26 | 1192 | 1105 |
| 12 | 17 | 22 | 1041 | 879 |
| 13 | 19 | 22 | 1165 | 891 |
| 14 | 18 | 23 | 1170 | 1105 |
| 15 | 16 | 21 | 974 | 956 |
| 16 | 19 | 25 | 1102 | 1007 |
| 17 | 17 | 22 | 806 | 695 |
| 18 | 19 | 28 | 1241 | 1092 |
| 19 | 17 | 24 | 1049 | 974 |
| 20 | 23 | 29 | 965 | 822 |
| 21 | 25 | 31 | 729 | 713 |
| 22 | 25 | 32 | 652 | 634 |
| 23 | 8 | 15 | >3000 | >3000 |
| 24 | >40 | >40 | 342 | 214 |
| 25 | >40 | BROKEN | <10 | <10 |
| 26 | <2 | <2 | >3000 | >3000 |
| 27 | 15 | 21 | 743 | 621 |
| 28 | 16 | 20 | 367 | 420 |
| 29 | 18 | 22 | 235 | 127 |
| 30 | 11 | 17 | 743 | 524 |
| 31 | 23 | 29 | 322 | <10 |
| 32 | 21 | 21 | 522 | 341 |
| 33 | 13 | 20 | 345 | 378 |
| 34 | 11 | 19 | 820 | 543 |
| 35 | 11 | 23 | 845 | 772 |
| 36 | 8 | 14 | 718 | 629 |
| 37 | 17 | 22 | 624 | 452 |
| 38 | 15 | 20 | 467 | 401 |
| 39 | 10 | 15 | 992 | 735 |
| 40 | 10 | 17 | 821 | 772 |
| 41 | 11 | 16 | 1032 | 879 |
| 42 | 12 | 19 | 1003 | 724 |
| 43 | 15 | 25 | 1074 | 876 |
| 44 | <2 | 7 | 1246 | 729 |
| 45 | 16 | 21 | <10 | 123 |
| 46 | 13 | 17 | 322 | 275 |
| 47 | <2 | <2 | 725 | 793 |
| 48 | 10 | 13 | 210 | 123 |
| 49 | <2 | <2 | <10 | 39 |
| 50 | 13 | 17 | <10 | <10 |
| 51 | 5 | <2 | <10 | <10 |
| 52 | 8 | <2 | <10 | <10 |
| 53 | 19 | 28 | <10 | 476 |
| 54 | 10 | 14 | 974 | 652 |
| 55 | 10 | 16 | 876 | 613 |
| 56 | 13 | 17 | 764 | 657 |
| 57 | 7 | 9 | 974 | 963 |
| 58 | 10 | 14 | 934 | 728 |
| 59 | 11 | 17 | <10 | 675 |
| 60 | 6 | 8 | 524 | 432 |
| 61 | 9 | 10 | 478 | 363 |
| 62 | 8 | 13 | 847 | 776 |
| 63 | 6 | 11 | 684 | 296 |
| 64 | 8 | 10 | 742 | 666 |

As is clearly shown in the test results, Samples No. 1 to 24, which are sintered bodies for tool cermet for the present invention, have superior breaking-resistance, shock-resistance, temperature adhesion-resistance, and plastic deformation-resistance because Sample No. 1 to 24 have the compositions shown in Table 4 and consist of Type-I and Type-II particles as the structural types of the particles as shown in Table 5.

Samples No. 1 to 24, which are sintered bodies for tool cermet for the present invention, have superior wear-resistance to those of Samples No. 25 to 64 provided for the purpose of comparison as the results of Tests 1 and 2 clearly indicates. The results of Test 3 and 4 show that Samples No. 1 to 24 take a greater number of collisions to break than Samples No. 25 to 64, thereby proving superior breaking-resistance of Samples No. 1 to 24.

The cermet for tools for the present invention has the predetermined compositions and Type-I and Type-II particles as the structural types of the particles as described above, which improves mechanical breaking-resistance, thermal shock-resistance, and plastic deformation-resistance without sacrificing superior mechanical wear-resistance and temperature adhesion-resistance which are inherent properties of cermet.

What is claimed is:

1. A cermet for use in tools comprising:

a hard dispersed phase composed of transitional metals selected from the group consisting of the group IVb metals, transitional metals selected from the group consisting of Vb metals, tungsten, carbon, and nitrogen, where the cermet is composed of substantially between 70 to 95 volume percentage of the hard dispersed phase, and a binder phase composed of at least one metal selected from the group consisting of the iron group metals of the group VIII metals, where the cermet is composed of substantially between 5 to 30 volume percentage of the binder phase;

wherein the hard dispersed phase comprises

Type-I particles, which are single phase particles, and

Type-II particles, which are dual phase particles having a core and at least one outer layer and having a composition varying from the core to the at least one outer layer such that the at least one outer layer is composed of more transitional metals selected from the group consisting of the group IVb metals than the core, and the core is composed of more transitional metals selected from the group consisting of the group Vb metals and tungsten than any outer layer of the Type-II particles.

2. The cermet of claim 1, wherein the ratio of transitional metals in group IVb, transitional metals in group Vb, and tungsten to carbon and nitrogen is 1.0:0.85–1.0.

3. The cermet of claim 2, wherein the ratio of transitional metals in group IVb to transitional metals in group Vb to tungsten is 0.50–0.85:0.05–0.30:0.05–0.30.

4. The cermet of claim 3, wherein one of the transitional metals selected from the group consisting of the group IVb metals is titanium and one of the transitional metals selected from the group consisting of the group Vb metals is tantalum, where the mole ratio of titanium to all of the transitional metals selected from the group consisting of the group IVb metals is 0.8–1:1 and the mole ratio of tantalum to all transitional metals selected from the group consisting of the group Vb metals is 0.30–1.0:1.0.

5. The cermet of claim 4, wherein the ratio of carbon to nitrogen is 0.40–0.90:0.10–0.60.

6. The cermet of claim 1, wherein the cermet contains substantially between 5 to 50 volume percentage of Type-I particles and 5 to 95 volume percentage of Type-II particles.

7. The cermet of claim 6, wherein:

the Type-I particles are composed of at least one nitride or carbonitride of transitional metals selected from the group consisting of the group IVb metals; and the Type-II particles comprise at least one transitional metal selected from the group consisting of the group IVb metals, at least one transitional metal selected from the group consisting of the group Vb metals, and tungsten.

8. The cermet of claim 1, wherein the composition of the Type-II particle varies gradually and sequentially from the cores to the outer layers.

9. The cermet of claim 7, wherein the ratio of nitrogen to and nitrogen in the Type-I particles is 0.25–1.0:1.

* * * * *